US006516663B2

(12) United States Patent
Wong

(10) Patent No.: US 6,516,663 B2
(45) Date of Patent: Feb. 11, 2003

(54) DOWNHOLE ELECTROMAGNETIC LOGGING INTO PLACE TOOL

(75) Inventor: Arnold J. Wong, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/778,357

(22) Filed: Feb. 6, 2001

(65) Prior Publication Data

US 2003/0000300 A1 Jan. 2, 2003

(51) Int. Cl.[7] ..... E21B 47/00; E21B 49/00; E21B 47/06

(52) U.S. Cl. ..... 73/152.52; 73/152.14; 166/254.2; 175/41; 175/45

(58) Field of Search ..... 73/152.52, 152.14, 73/152.02; 166/254.2, 254.1, 250.01; 175/41, 45; 250/269.3

(56) References Cited

U.S. PATENT DOCUMENTS

| | | | | | |
|---|---|---|---|---|---|
| 2,470,743 | A | * | 5/1949 | Hochgesang et al. | 250/53 |
| 2,508,722 | A | * | 5/1950 | Pontecorvo | 250/83.6 |
| 2,659,014 | A | * | 11/1953 | Scherbatskoy | 250/83.6 |
| 2,993,994 | A | * | 7/1961 | Herrog | 250/83.3 |
| 3,071,687 | A | * | 1/1963 | Youmans | 250/83.3 |
| 3,490,280 | A | * | 1/1970 | Fields | 73/152.14 |
| 3,566,682 | A | * | 3/1971 | Winkler, Jr. | 73/152.14 |
| 3,611,799 | A | | 10/1971 | Davis | 73/155 |
| 4,226,116 | A | * | 10/1980 | Denison | 73/152.02 |
| 4,320,800 | A | | 3/1982 | Upchurch | 166/106 |
| 4,510,797 | A | * | 4/1985 | Guidry et al. | 73/152.55 |
| 4,566,318 | A | * | 1/1986 | Rao et al. | 73/152.02 |
| 4,570,480 | A | * | 2/1986 | Fontenot et al. | 73/155 |
| 4,580,632 | A | | 4/1986 | Reardon | 166/250 |
| 4,585,939 | A | | 4/1986 | Arnold et al. | 250/256 |
| 4,628,202 | A | | 12/1986 | Minette | 250/269 |
| 4,790,378 | A | * | 12/1988 | Montgomery et al. | 166/66 |
| 4,794,336 | A | * | 12/1988 | Marlow et al. | 324/221 |
| 4,883,956 | A | | 11/1989 | Melcher et al. | 250/269 |
| 4,898,236 | A | | 2/1990 | Sask | 166/65.1 |
| 5,010,764 | A | * | 4/1991 | Taylor | 73/152.52 |
| 5,019,978 | A | * | 5/1991 | Howard, Jr. et al. | 364/422 |

(List continued on next page.)

FOREIGN PATENT DOCUMENTS

FR 2 621 072 3/1989

OTHER PUBLICATIONS

U.S. patent application Ser. No. 09/778,051, Filed Feb. 6, 2001, David Hosie, et al., "Apparatus And Methods For Placing Downhole Tools In A Wellbore".
PCT International Search Report from International application No. PCT/GB02/00286, Dated Apr. 12, 2002.

*Primary Examiner*—Hezron Williams
*Assistant Examiner*—David J. Wiggins
(74) *Attorney, Agent, or Firm*—Moser, Patterson & Sheridan, L.L.P.

(57) ABSTRACT

Apparatus and method for accurately logging a drill-stem test tool into place as the DST tool is conveyed by drill pipe or tubing to the desired location are provided. One aspect of the invention provides an apparatus for logging into place a drill stem test tool, comprising: a drill string comprising drill pipes or tubings; a drill stem test tool disposed on the drill string; an electromagnetic telemetry tool disposed on the drill string; and a gamma ray tool connected to the electromagnetic telemetry tool. Another aspect of the invention provides a method for logging into place a drill stem test tool disposed on a drill string, comprising: lowering a drill stem test tool, an electromagnetic telemetry tool and a gamma ray tool disposed on a drill string into a wellbore; producing a partial log utilizing the gamma ray tool while the drill stem test tool is moved adjacent a correlative formation marker; compare the partial log to a well log to determine a depth position adjustment; and adjust a position of the drill stem test tool according to the depth position adjustment.

16 Claims, 6 Drawing Sheets

U.S. PATENT DOCUMENTS

| | | | | | |
|---|---|---|---|---|---|
| 5,081,351 | A | | 1/1992 | Roscoe et al. | 250/270 |
| 5,279,366 | A | | 1/1994 | Scholes | 166/254 |
| 5,394,141 | A | | 2/1995 | Soulier | 340/854.4 |
| 5,410,152 | A | | 4/1995 | Gadeken | 250/260 |
| 5,530,359 | A | | 6/1996 | Habashy et al. | 324/338 |
| 5,581,024 | A | * | 12/1996 | Meyer, Jr. et al. | 73/152.03 |
| 5,635,631 | A | | 6/1997 | Yesudas et al. | 73/61.46 |
| 5,753,813 | A | * | 5/1998 | Hagiwara | 73/152.54 |
| 5,799,733 | A | | 9/1998 | Ringgenberg et al. | 166/264 |
| 5,945,923 | A | | 8/1999 | Soulier | 340/854.6 |
| 6,101,445 | A | | 8/2000 | Alvarado et al. | 702/9 |

* cited by examiner

DOWNHOLE ELECTROMAGNETIC LOGGING INTO PLACE TOOL

BACKGROUND OF THE INVENTION

1. Field of the Invention

The present invention generally relates to a logging into place tool. More particularly, the present invention relates to a logging into place tool having a gamma-ray tool and an electromagnetic telemetry tool attached to a drill stem test string.

2. Background of the Related Art

A drill-stem test (DST) system is commonly used in connection with hydrocarbon exploration and exploitation. The primary purpose of the DST is to obtain a maximum stabilized reservoir pressure, a stabilized flow rate, and representative samples formation fluids and gasses. The hydrocarbon reservoir's potential is evaluated utilizing various reservoir engineering calculations and the collected data/information.

Drill stem test systems commonly have a multi-section housing which contains or supports a number of test-related devices, which collectively may be referred to as the drill stem test tool or DST tool. The housing sections are formed with internal conduits which, when the housing sections are assembled, co-operate to define a network of fluid flow paths required for the testing procedure. The housing sections are assembled at the surface and then lowered on the end of the drill string (e.g., drill pipes or tubings) to the desired test depth corresponding to a prospective zone of interest.

Inflatable (or otherwise expandable) packers carried by certain of the housing sections engage the wellbore to isolate a test region. A single packer may be provided if only the bottom of the wellbore is to be tested, but it is common practice to provide a pair of packers which permit a test region intermediate of the top and bottom of the wellbore to be isolated.

For conventional testing, weight may be set down on the drill string to expand the packers against the wellbore. For inflate testing, a pump may be positioned in the drill-stem test string to pump wellbore drill fluid (commonly referred to as "mud") into the packers for inflation. Once the packers are set, a test valve is opened to introduce a flow of fluid from the test region into one of the channels formed in the drill stem test string. Upon completion of the initial flow period, the test valve is then closed (i.e., shut-in) to allow the formation to recover and build back to its original shut-in pressure. Repetitive flows and shut-ins are routinely performed to gather additional reservoir evaluation data. The drill stem test system is then retrieved to permit interpretation of the recorded pressure and temperature data and analysis of the fluids and/or gas samples trapped by the DST tool during the flow period.

Typically, the DST tool is conveyed downhole using tubing or drill-pipe to a prospective zone of interest based upon previously measured depth and formation correlation from open hole wireline logs, e.g., a gamma-ray well log. However, during the process of conveying the DST tool with tubing or drill-pipe, improper or inaccurate measurements of the length of the drill string may take place due to inconsistent lengths of collars and drill-pipes, pipe stretch, pipe tabulation errors, etc., resulting in erroneous placement of the DST tool. Thus, DST tests may be performed in the wrong zone of interest, and incorrect decisions may result as to whether the formations being tested is a hydrocarbon-bearing formation. Furthermore, repeating the drill-stem test may be very costly both in expenses and time.

Therefore, a need exists for an apparatus and method for accurately logging a drillstem test tool into place as the DST tool is conveyed by drill pipe or tubing to the desired location.

SUMMARY OF THE INVENTION

Apparatus and method for accurately logging a drill-stem test (DST) tool into place as the DST tool is conveyed by drill pipe or tubing to the desired location are provided.

One aspect of the invention provides an apparatus for logging into place a drill stem test tool, comprising: a drill string comprising drill pipes or tubings; a drill stem test tool disposed on the drill string; an electromagnetic telemetry tool disposed on the drill string; and a gamma ray tool connected to the electromagnetic telemetry tool.

Another aspect of the invention provides a method for logging into place a drill stem test tool disposed on a drill string, comprising: lowering a drill stem test tool, an electromagnetic telemetry tool and a gamma ray tool disposed on a drill string into a wellbore; producing a partial log utilizing the gamma ray tool while the drill stem test tool is moved adjacent a correlative formation marker; compare the partial log to a well log to determine a depth position adjustment; and adjust a position of the drill stem test tool according to the depth position adjustment.

Another aspect of the invention provides an apparatus for testing a well, comprising: a downhole system comprising a drill stem test tool disposed on a drill string and an electromagnetic telemetry tool having a gamma ray tool disposed on the drill string; and a surface system comprising a controller disposed in communication with the downhole system.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
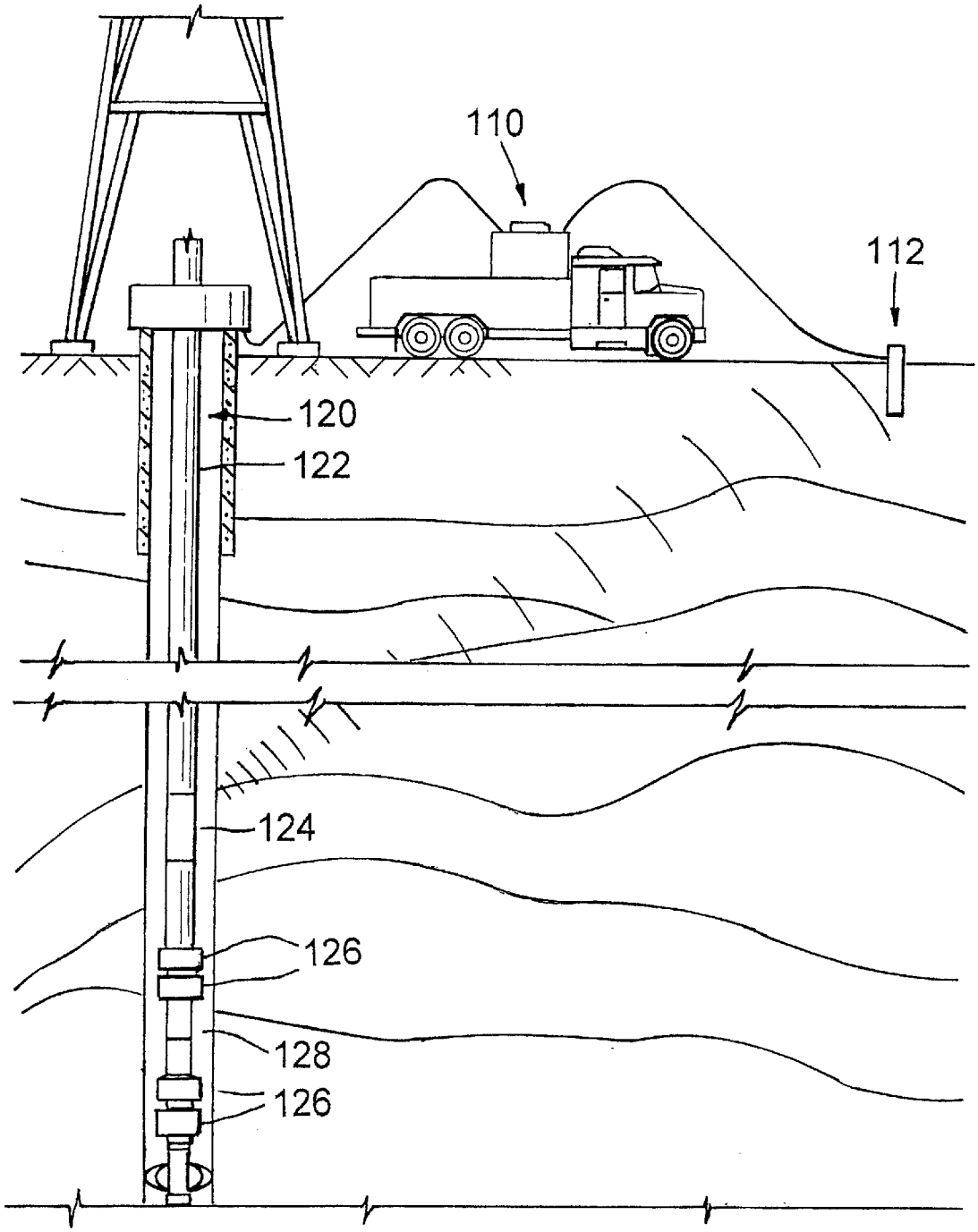
FIG. 1 is a schematic diagram of a well testing system incorporating a drill stem test tool, an electromagnetic telemetry tool having a gamma ray tool according to the invention.

FIG. 1 is a schematic diagram of a well testing system incorporating a drill stem test tool, an electromagnetic telemetry tool having a gamma ray tool according to the invention. The gamma ray tool and the electromagnetic telemetry tool instrumentation may be encapsulated in a pressure housing mounted within a drill-stem test tool. The well testing system 100 generally comprises a surface unit 110 and a downhole test string 120. The surface unit 110 may include one or more processors, computers, controllers, data acquisition systems, signal transmitter/receiver or transceivers, interfaces, power supplies and/or power generators and other components. In one embodiment, the surface unit 110 is housed in a mobile truck. An antenna 112, such as a metal ground stake or other receiving instrumentation may be disposed or driven into the ground and connected to the surface unit 110 to receive and/or transmit signals to and/or from components in the downhole test string 120. In one embodiment, the antenna 112 is disposed at about 100 feet (radial distance) away from the surface unit 110 with another connection from the surface unit 110 to the Blow Out Preventor (BOP) or other electrically conductive path to the drill string. The downhole string 120 includes a plurality of drill-pipe or tubing 122, an electromagnetic telemetry tool having a gamma ray tool attached thereon 124, one or more packers 126 and a drill stem test (DST) tool 128. The plurality of drill-pipe or tubing 122 are connected from the surface to extend to the other components of the test string downhole. The electromagnetic telemetry tool 124 includes a transceiver for communicating with the surface unit 110. The one or more packers 126 provide a sealed section of the zone of interest in the wellbore to be tested.

Figure 2A:
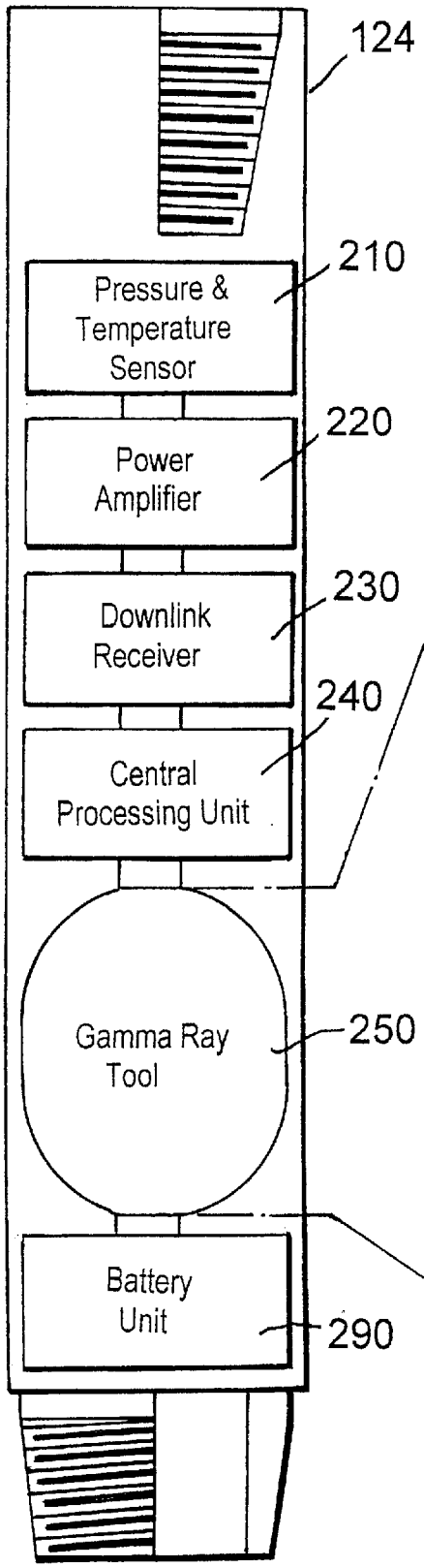
FIG. 2 is a schematic diagram of an electromagnetic telemetry tool having a gamma ray tool according to the invention.

FIG. 2A is a schematic diagram of an electromagnetic telemetry tool having a gamma ray tool according to the invention. The electromagnetic telemetry tool 124 generally includes a pressure and temperature sensor 210, a power amplifier 220, a downlink receiver 230, a central processing unit 240, a gamma ray tool 250, and a battery unit 290. The electromagnetic telemetry tool 124 is selectively controlled by signals from the surface unit to operate in a pressure/temperature sensing mode which provides for a record of pressure versus time or in a gamma ray mode which records gamma counts as the DST tool is raised or lowered past a correlative formation marker. The record of gamma counts is then transmitted to surface and merged with the surface system depth/time management software to produce a gamma-ray mini-log which is later compared to the wireline open-hole gamma ray log to evaluate the exact drill stem test tool depth.

Figure 2B:
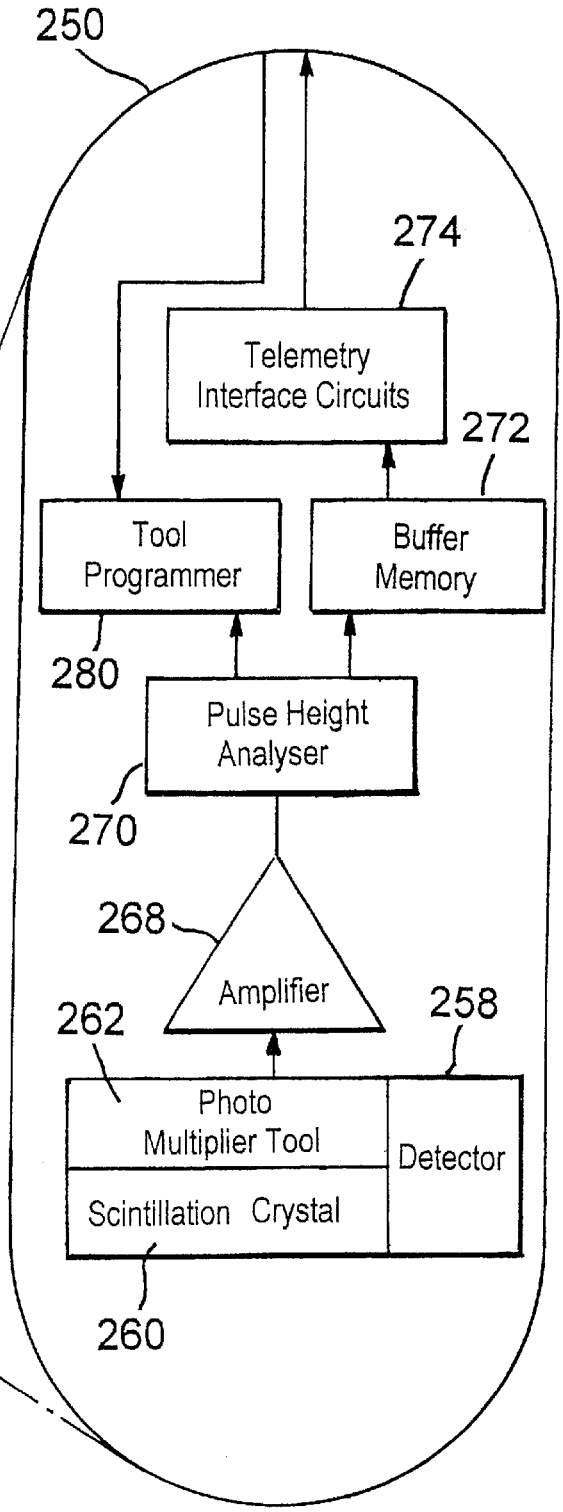

The gamma ray tool 250, shown in FIG. 2B, includes a radiation detector 258 for detecting naturally occurring gamma radiation from the formation. The detector 258 is of a type appropriate to the detection of gamma radiation and the production of an electrical signal corresponding to each detected gamma ray and having an amplitude representative of the energy of the gamma ray. The detector 258 includes a scintillation crystal or scintillator 260 which is optically coupled to a photomultiplier tube (PMT) 262. The scintillator 260 may comprise a gadolinium-containing material, such as gadolinium orthosilicate that is suitably doped, for example with cerium, to activate for use as a scintillator. The quantity of cerium in terms of number of atoms is typically of the order of about 0.1% to about 1% of the quantity of gadolinium. The scintillator may comprise other materials, such as sodium iodide doped with thalium (NaI)(Tl), bismuth germanate, cesium iodide, and other materials.

Electrical power for the gamma ray tool 250 is supplied from the battery unit 290. The gamma ray tool 250 includes power conditioning circuitry (not shown) for feeding power at appropriate voltage and current levels to the detector 258 and other downhole circuits. These circuits include an amplifier 268 and associated circuitry which receives the output pulses from photomultiplier tube (PMT) 262. The amplified pulses are then applied to a pulse height analyzer (PHA) 270 which includes an analog-to-digital converter which may be of any conventional type such as the single ramp (Wilkinson rundown) type. Other suitable analog to digital converters may be used for the gamma ray energy range to be analyzed. Linear gating circuits may also be employed for control of the time portion of the detector signal frame to be analyzed. Improved performance can be obtained by the use of additional conventional techniques such as pulse pile-up rejection.

The pulse height analyzer 270 may assign each detector pulse to one of a number (typically in the range 256 to 8000) of predetermined channels according to its amplitude (i.e., the gamma ray energy), and produces a signal in suitable digital form representing the channel or amplitude of each analyzed pulse. Typically, the pulse height analyzer 270 includes memory in which the occurrences of each channel number in the digital signal are accumulated to provide an energy spectrum. The accumulated totals are then transferred via a buffer memory 272 (which can be omitted in certain circumstances) to the telemetry interface circuits 274 for transmission to the surface equipment.

At the surface, the signals are received by the signal processing circuits, which may be of any suitable known construction for encoding and decoding, multiplexing and demultiplexing, amplifying and otherwise processing the signals for transmission to and reception by the surface equipment. The operation of the gamma ray tool 250 is controlled by signals sent downhole from the surface equipment. These signals are received by a tool programmer 280 which transmits control signals to the detector 258 and the pulse height analyzer 270.

The surface equipment includes various electronic circuits used to process the data received from the downhole equipment, analyze the energy spectrum of the detected gamma radiation, extract therefrom information about the formation and any hydrocarbons that it may contain, and produce a tangible record or log of some or all of this data and information, for example on film, paper or tape. These circuits may comprise special purpose hardware or alternatively a general purpose computer appropriately programmed to perform the same tasks as such hardware. The data/information may also be displayed on a monitor and/or saved in a storage medium, such as disk or a cassette. The surface system may also include a depth-measuring system for measuring a depth position of the drill string/tubing or a component on the drill string.

Figure 3:
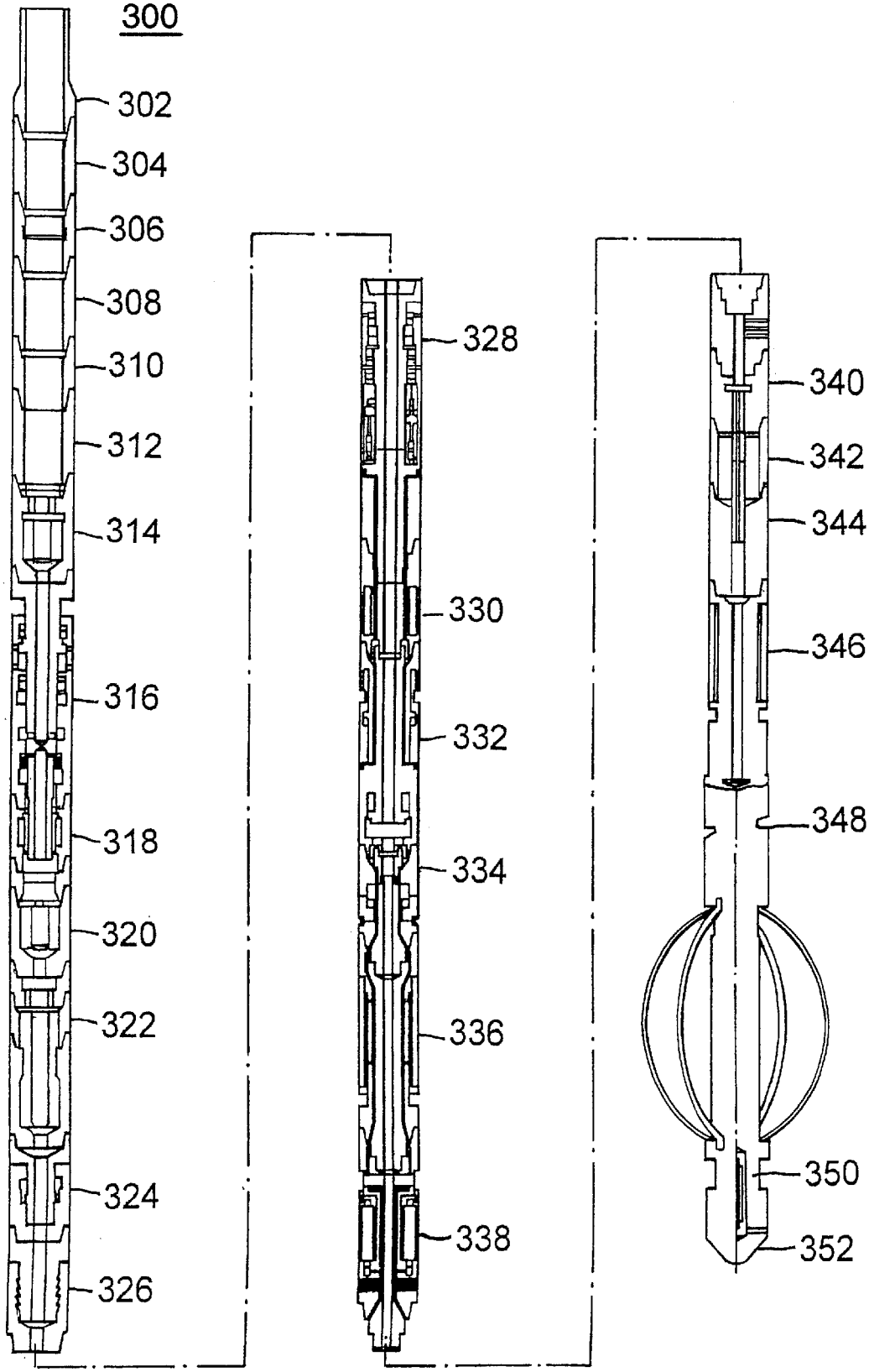
FIG. 3 is a schematic diagram of one embodiment of a test string incorporating an inflate straddle drill stem test tool having an electromagnetic telemetry tool and a gamma ray tool according to the invention.

FIG. 3 is a schematic of one embodiment of a test string incorporating an inflatable straddle, drill stem test tool having an electromagnetic telemetry tool and a gamma ray tool according to the invention. The test string 300 includes a plurality of drill pipe sections 302 that extend from the surface. A plurality of components may be attached to the test string to perform the drill stem test for particular well conditions. For example, the test string may comprise an inflatable straddle assembly for testing a particular section of the wellbore. In one embodiment, as shown in FIG. 3, the test string 300 includes the following components connected in order downward from the drill pipe sections 302; first drill collars 304, a reversing sub 306, second drill collars 308, a pressure activated reverse circulating sub 310, a cross over sub 312, a fluid recovery recorder 314, a hydraulic main valve 316, a reservoir flow sampler 318, an inside recorder carrier 320, an electromagnetic telemetry tool with a gamma ray tool 322, hydraulic jars 324, a safety joint 326, a pump 328, a screen sub 330, a valve section 332, a back-up deflate tool 334, a first inflatable packer 336, a recorder carrier and flow sub 338, a hanger sub 340, a drill collar spacer 342, a bypass receiver sub 344, a second inflatable packer 346, a clutch drag spring unit 348, an electronic or mechanical recorder 350, and a bull nose 352. The embodiment shown in FIG. 3 may be modified to include additional components or detail as needed for particular types of tests. Also, additional packers may be disposed adjacent the packers 336 and/or 346 to provide enhanced seal to the wellbore.

Figure 4:
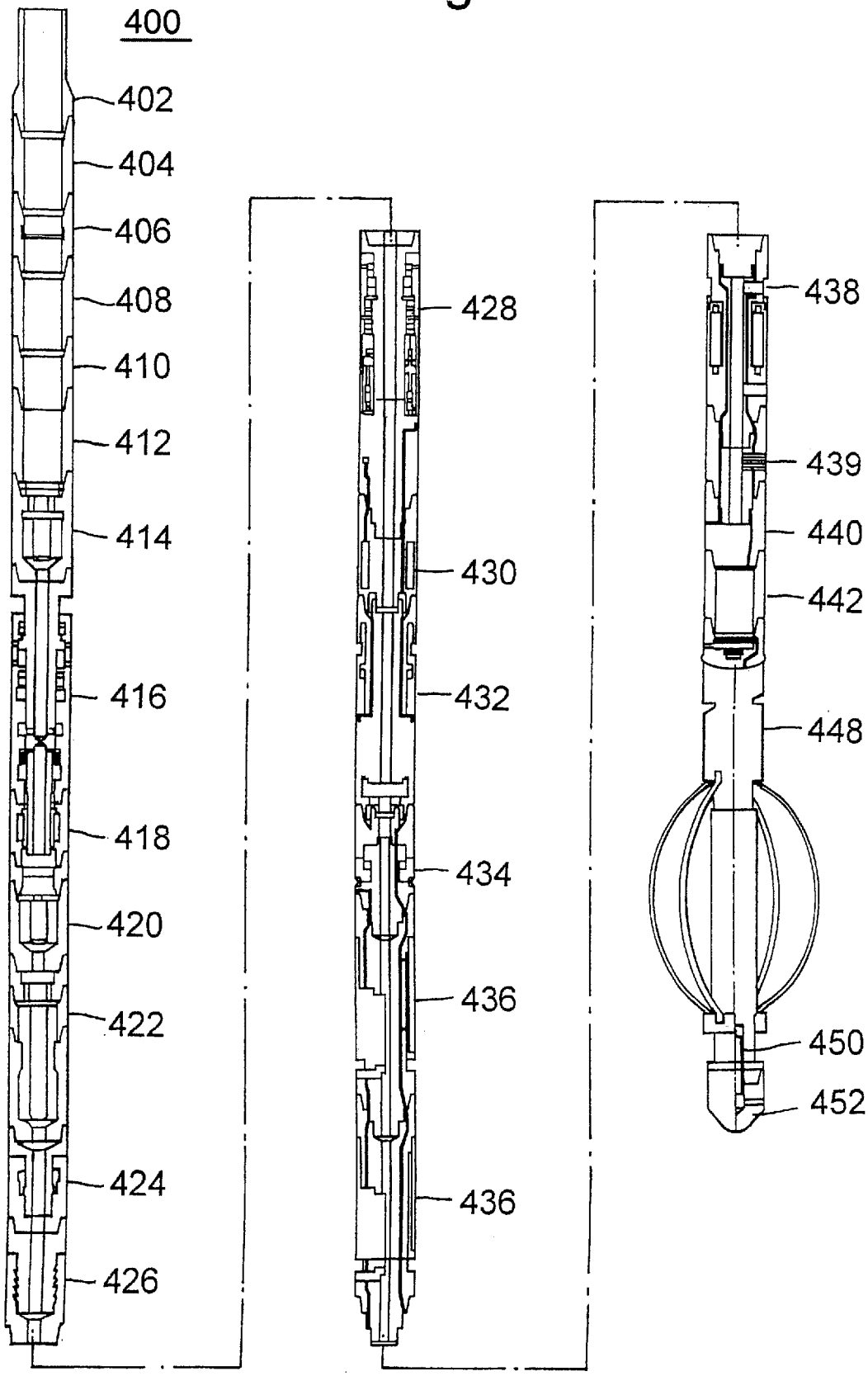
FIG. 4 is a schematic diagram of another embodiment of a test string incorporating an inflate bottom hole drill stem test tool having an electromagnetic telemetry tool and a gamma ray tool according to the invention.

FIG. 4 is a schematic diagram of another embodiment of a test string incorporating an inflate bottom hole drill stem test tool having an electromagnetic telemetry tool and a gamma ray tool according to the invention. In the embodiment shown in FIG. 4, the test string 400 comprises an inflatable bottom hole assembly for testing a bottom section of the wellbore. The test string 400 includes the following components connected in order downward from drill pipe sections 402; first drill collars 404, a reversing sub 406, second drill collars 408, a pressure activated reverse circulating sub 410, a cross over sub 412, a fluid recovery recorder 414, Hydraulic Main Valve 416, a reservoir flow sampler 418, an inside recorder carrier 420, an electromagnetic telemetry tool with a gamma ray tool 422, hydraulic jars 424, a safety joint 426, a pump 428, a screen sub 430, a valve section 432, a back-up deflate tool 434, one or more inflatable packers 436, a recorder carrier 438 and flow sub 439, a drag spring extension sub 440, a drill collar spacer 442, a clutch drag spring unit 448, an electronic or mechanical recorder 450, and a bull nose 452.

Figure 5:
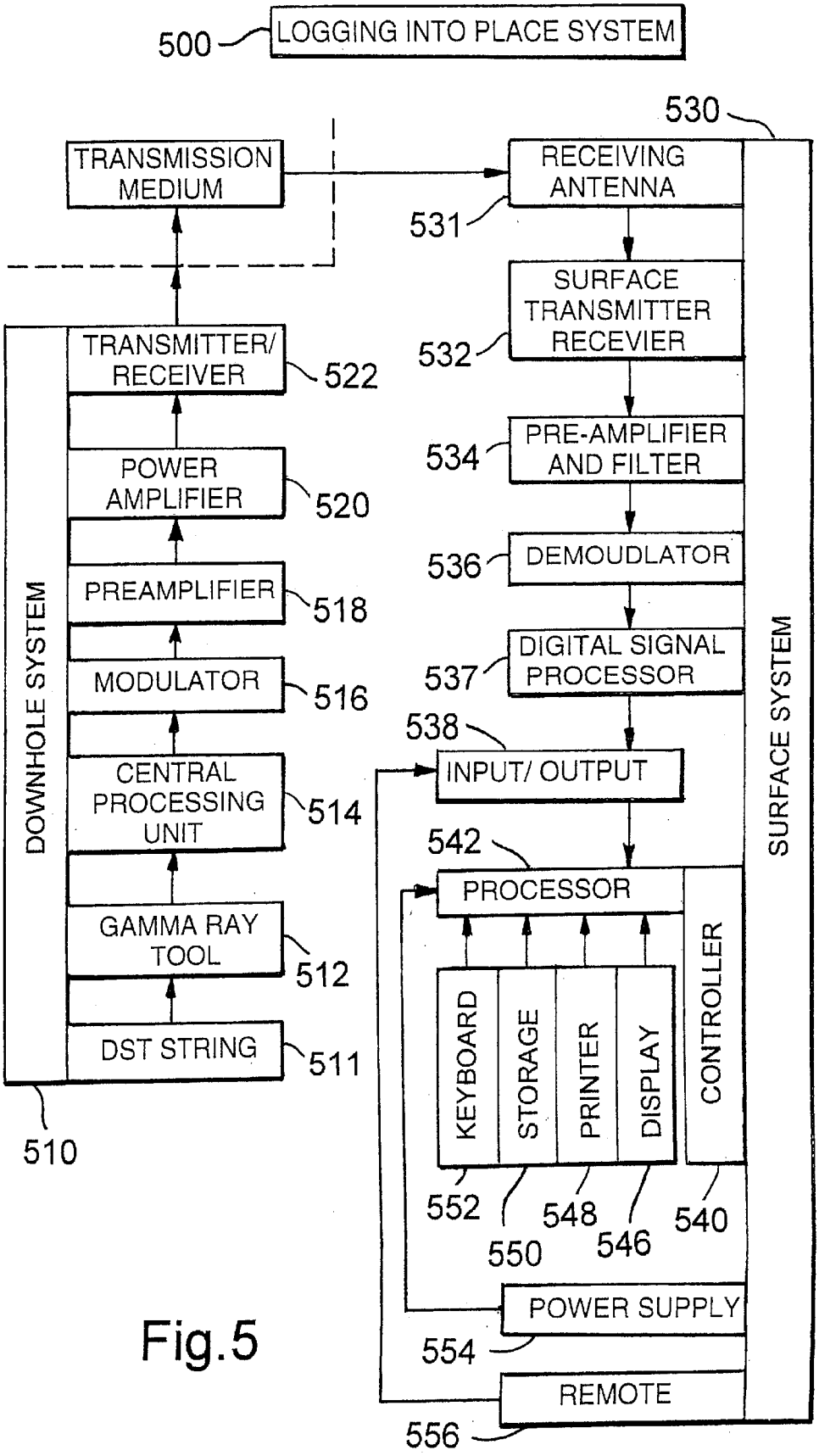
FIG. 5 is a schematic diagram of one embodiment of a well testing system having a downhole system and a surface system.

FIG. 5 is a schematic diagram of one embodiment of a logging into place system. The logging into place system 500 includes a downhole system 510 and a surface system 530. In relation to the embodiment shown in FIG. 1, and the downhole system 510 includes the downhole test string 120 as shown in FIG. 1. Referring to the block diagram in FIG. 5, the downhole system 510 includes a drill stem test string 511, a gamma-ray tool 512, central processing unit 514, a modulator 516, a pre-amplifier 518, a power amplifier 520, and a transmitter/receiver 522. One or more of these components may be housed in the telemetry tool 124 (in FIG. 1). The DST string 511 provides for mechanical manipulation at surface to open and close downhole valves and also allow for surface manipulation in order to inflate the downhole pump in order to inflate packers against the wellbore. Housed within the DST string is the electromagnetic telemetry system with a gamma ray tool controlled by signals transmitted from the surface system. A command is transmitted from surface to downhole to start recording and storing to memory a record of gamma counts as the tool is conveyed up or down past a correlative marker (formation). As time and conveyed depth measurements are stored at surface by the surface system, the measurements are correlated to the downhole gamma counts after being transmitted. A mini gamma ray log is generated and compared to the wireline open-hole for drill-pipe conveyed depth versus the log depth from the original wireline open hole log. The DST tool is then positioned up or down relative to the correlated measured depth from the open hole log.

Communication between the downhole system 510 and the surface system 530 may be achieved through wireless electromagnetic borehole communication methods, such as the Drill-String/Earth Communication (i.e.: D-S/EC) method. The D-S/EC method utilizes the drill string or any electrical conductor, such as the casing or tubing and the earth as the conductor in a pseudo-two-wire-transmission mode.

The surface system 530 includes a receiving antenna 531, a surface transmitter/receiver 532, a preamplifier/filter 534, a demodulator 536, a digital signal processor 537, a plurality of input/output connections or I/O 538, and a controller 540. The controller 540 includes a processor 542, and one or more input/output devices such as, a display 546 (e.g. Monitor), a printer 548, a storage medium 550, keyboard 552, mouse and other input/output devices. A power supply 554 and a remote control 556 may also be connected to the input/output 538.

Figure 6:
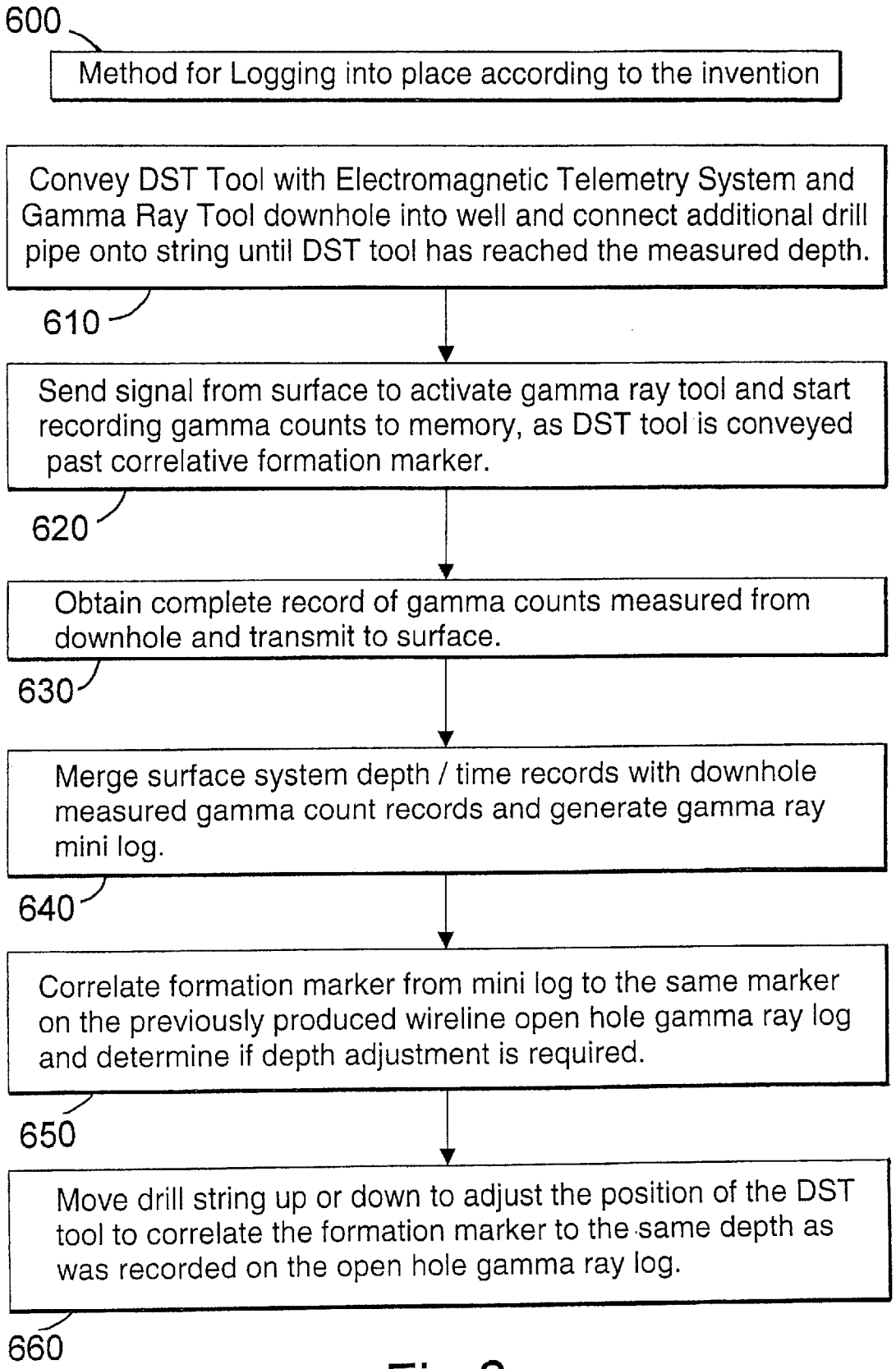
FIG. 6 is a flow diagram illustrating one embodiment of a method for logging into place a drill stem test tool according to the invention.

FIG. 6 is a flow diagram illustrating one embodiment of a method 600 for logging into place a DST tool according to the invention. To begin the logging into place method 600, the DST tool is conveyed downhole into the wellbore with the electromagnetic telemetry tool and gamma ray tool. A plurality of drill pipes or tubings are connected onto the drill string until the measured depth is reached. (step 610) As the drill string is lowered into the wellbore past the prospective correlative formation, the tool is stopped and a downlink command from the surface system is sent ordering the gamma ray tool to start recording data to memory. (step 620) The drill string is then raised, for example, at a rate of approximately 5 meters per minute, to record gamma counts as the gamma ray tool passes by differing lithologies. After a distance of approximately 30 meters has logged, the complete record of downhole gamma counts is transmitted to surface. (step 630) A partial log (or mini log) is generated by merging the recorded surface depth/time records with the downhole gamma count record. (step 640) The partial log is then compared to a previously produced well log (e.g., open-hole gamma-ray log) and correlated to the same marker formation. (step 650) As the open hole gamma-ray log is considered correct, a depth position adjustment, if necessary, is calculated based on the comparison of the partial log to the open hole gamma-ray log. The drill-string is moved up or down by adding or removing drill pipe(s) or tubing(s) to adjust the position of the DST tool. (step 660) After the DST tool has been logged into place at a correct depth, the drill stem test may commence.

The drill stem test provides reservoir data under dynamic conditions, including stabilized shut-in formation pressures, flow pressures and rates. The DST also records temperature measurements and collects representative samples of the formation fluids. Additionally, the drill stem test also provides for data to calculate reservoir characteristics including but not limited, to permeability, well bore damage, maximum reservoir pressure, reservoir depletion or drawdown, radius of investigation, anomaly indications, and other qualitative and quantitative information regarding the well.

While the foregoing is directed to the preferred embodiment of thee present invention, other and further embodiments of the invention may be devised without departing from the basic scope thereof, and the scope thereof is determined by the claims that follow.

I claim:

1. An apparatus for logging into place a drill stem test tool, comprising:

a drill string comprising drill pipes or tubings;

a drill stem test tool disposed on the drill string for facilitating a drill stem test;

an electromagnetic telemetry tool disposed on the drill string for transmitting information for determining a position of the drill stem test tool; and a gamma ray tool connected to the electromagnetic telemetry tool.

2. The apparatus of claim 1 wherein the electromagnetic telemetry tool comprises:

a processor;

a battery connected to the processor; and a transmitter/receiver disposed in communication with the processor.

3. The apparatus of claim 2 wherein the electromagnetic telemetry tool further comprises:

a modulator disposed in communication with the processor;

a preamplifier disposed in communication with the modulator; and a power amplifier disposed in communication with the preamplifier and with the transmitter/receiver.

4. The apparatus of claim 2 wherein the electromagnetic telemetry tool further comprises:

a pressure sensor; and a temperature sensor, both sensors disposed in communication with the processor.

5. The apparatus of claim 1 wherein the gamma ray tool comprises a radiation detector.

6. The apparatus of claim 5 wherein the gamma ray tool further comprises a telemetry tool interface disposed in communication with the electromagnetic telemetry tool.

7. The apparatus of claim 1, further comprising:

a surface system comprising a controller having input/output devices and a transmitter/receiver disposed in connection with the controller to communicate signals selectively with the telemetry tool and the gamma ray tool.

8. The apparatus of claim 7 wherein the surface system further comprises:

a modulator/demodulator connected between the transmitter/receiver and the controller.

9. The apparatus of claim 7 wherein the surface system further comprises a depth-measuring system for measuring a depth position of the gamma ray tool.

10. A method for logging into place a drill stem test tool disposed on all string, comprising:

lowering a drill stem test tool, an electromagnetic telemetry tool and a gamma ray tool disposed on a drill string into a wellbore;

producing a partial log utilizing the gamma ray tool while the drill stem test tool is moved adjacent a correlative formation marker;

comparing the partial log to a well log to determine a depth position adjustment; and adjusting a position of the drill stem test tool according to the depth position adjustment.

11. The method of claim 10, further comprising:

transmitting signals representing data collected by the gamma ray tool to a surface system.

12. The method of claim 11 wherein the signals are transmitted utilizing an electromagnetic transmission method.

13. The method of claim 12 wherein the partial log is produced by correlating data collected by the gamma ray tool to depth/time data in a surface depth-measuring system.

14. The method of claim 10 wherein the drill string comprises a plurality of drill pipes or tubings and the drill stem test tool is lowered by connecting additional drill pipe or tubing to the drill string.

15. The method of claim 10 wherein the partial log is produced by raising the drill stem test tool past the correlative formation marker based on a measured length of the drill string.

16. The method of claim 10, further comprising:

transmitting a signal from a surface system to selectively activate the gamma ray tool.

* * * * *